US011428237B2

(12) United States Patent
Kabasawa

(10) Patent No.: US 11,428,237 B2
(45) Date of Patent: Aug. 30, 2022

(54) VACUUM PUMP, STATOR COLUMN, BASE, AND EXHAUST SYSTEM OF VACUUM PUMP

(71) Applicant: Edwards Japan Limited, Chiba (JP)

(72) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 17/253,364

(22) PCT Filed: Jun. 13, 2019

(86) PCT No.: PCT/JP2019/023435
§ 371 (c)(1),
(2) Date: Dec. 17, 2020

(87) PCT Pub. No.: WO2020/004055
PCT Pub. Date: Jan. 2, 2020

(65) Prior Publication Data

US 2021/0262484 A1 Aug. 26, 2021

(30) Foreign Application Priority Data

Jun. 27, 2018 (JP) ..... JP2018-121763

(51) Int. Cl.
*F04D 29/32* (2006.01)
*F04D 13/06* (2006.01)
*F04D 19/04* (2006.01)

(52) U.S. Cl.
CPC ..... *F04D 29/321* (2013.01); *F04D 13/06* (2013.01); *F04D 19/042* (2013.01); *F05D 2210/12* (2013.01)

(58) Field of Classification Search
None
See application file for complete search history.

(56) References Cited

U.S. PATENT DOCUMENTS 6,220,831 B1 * 4/2001 Shiokawa ..... F04D 29/524 417/423.4
6,419,461 B2 * 7/2002 Okada ..... F04D 19/042 417/373

(Continued)

FOREIGN PATENT DOCUMENTS

EP 3594504 A1 1/2020
JP H10299689 A 11/1998

(Continued)

OTHER PUBLICATIONS

PCT International Search Report dated Sep. 3, 2019 for corresponding PCT application Serial No. PCT/JP2019/023435, 2 pages.

(Continued)

*Primary Examiner* — Courtney D Heinle
*Assistant Examiner* — Jason Fountain
(74) *Attorney, Agent, or Firm* — Theodore M. Magee; Westman, Champlin & Koehler, P.A.

(57) ABSTRACT

The present invention provides a vacuum pump that measures the temperature of a rotating portion accurately and at low cost, a stator column of the vacuum pump, a base, and an exhaust system of the vacuum pump at low cost. The vacuum pump according to the present embodiment, the thread groove-type seal for causing some of the purge gas to flow back toward the temperature sensor unit is provided on the downstream side of the purge gas flow path in which the temperature sensor unit is disposed, thereby increasing the pressure of the purge gas in the vicinity of the temperature sensor unit. Thus, with the small amount of purge gas, the gas pressure around the temperature sensor unit can create an intermediate flow or a viscous flow. Consequently, the total amount of purge gas to be supplied can be saved, resulting in cost reduction.

6 Claims, 10 Drawing Sheets

(56) References Cited

U.S. PATENT DOCUMENTS

| | | | | |
|---|---|---|---|---|
| 10,260,509 | B2 * | 4/2019 | Sakaguchi | F04D 29/28 |
| 10,837,836 | B2 * | 11/2020 | Haslett | F04D 19/04 |
| 2009/0101214 | A1 * | 4/2009 | North | F04D 19/046<br>137/15.04 |
| 2011/0200460 | A1 * | 8/2011 | Nonaka | F04D 27/001<br>417/63 |
| 2016/0138602 | A1 * | 5/2016 | Sakaguchi | F04D 29/28<br>415/208.1 |
| 2019/0226914 | A1 * | 7/2019 | Haslett | G01J 5/041 |

FOREIGN PATENT DOCUMENTS

| | | | |
|---|---|---|---|
| JP | H1137087 | A | 2/1999 |
| JP | H1162880 | A | 3/1999 |
| JP | 3201348 | B | 8/2001 |
| JP | 3795979 | B2 | 7/2006 |
| JP | 2010038137 | A | 2/2010 |
| JP | 2013101145 | A | 5/2013 |
| JP | 2014190343 | A | 10/2014 |
| WO | 2010021307 | A1 | 2/2010 |

OTHER PUBLICATIONS

PCT International Written Opinion dated Sep. 3, 2019 for corresponding PCT application Serial No. PCT/JP2019/023435, 6 pages.
EP Communication Feb. 11, 2022 and Search Report dated Feb. 2, 2022 for corresponding European application Serial No. EP19827178.5, 8 pages.

* cited by examiner

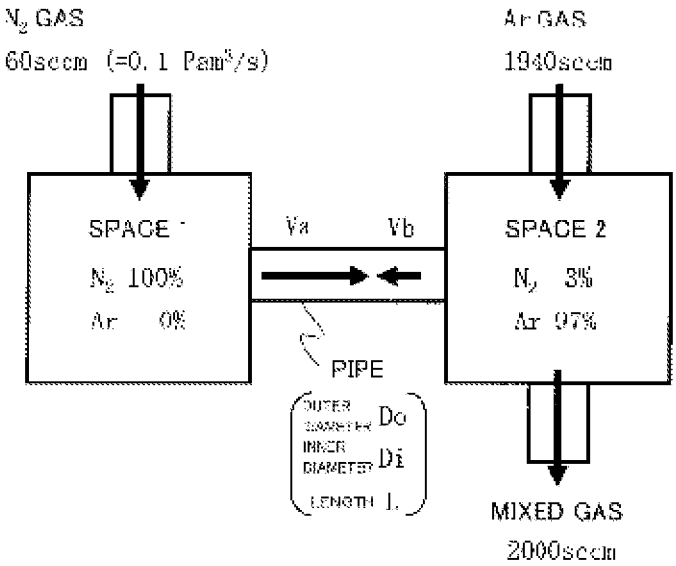

1. CALCULATION CONDITIONS

| ITEMS | SYMBOL | UNIT | CONDITION 1 | CONDITION 2 | CONDITION 3 |
|---|---|---|---|---|---|
| PRESSURE | P | Pa | 266 | 266 | 266 |
| TEMPERATUR | T | ℃ | 27 | 27 | 27 |
| OUTER DIAMETER OF FLOW PATH | Do | mm | 200 | 200 | 200 |
| INNER DIAMETER OF FLOW PATH | Di | mm | 190 | 198 | 198 |
| LENGTH OF FLOW PATH | L | m | 0.01 | 0.01 | 0.01 |
| AMOUNT OF $N_2$ GAS SUPPLIED | Q | sccm | 60 | 60 | 20 |

2. INTERMEDIATE CALCULATION VALUES

| | | | | | |
|---|---|---|---|---|---|
| TEMPERATURE | T | K | 300 | 300 | 300 |
| AVERAGE THERMAL VELOCITY | v | m/s | 398 | 398 | 398 |
| MEAN FREE PATH | λ | m | 2.6E-05 | 2.6E-05 | 2.6E-05 |
| DIFFUSION COEFFICIENT OF Ar | D | $m^2/s$ | 3.5E-03 | 3.5E-03 | 3.5E-03 |
| CROSS-SECTIONAL AREA OF FLOW PATH | S | $m^2$ | 0.00306 | 0.00063 | 0.00063 |
| AMOUNT OF $N_2$ SUPPLIED | Q | $Pam^3/s$ | 0.10 | 0.10 | 0.03 |
| VALUME FLOW RATE OF $N_2$ | Qv | $m^3/s$ | 3.8E-04 | 3.8E-04 | 1.3E-04 |

3. CALCULATION RESULTS

| | | | | | |
|---|---|---|---|---|---|
| FLOW VELOCITY IN FLOW PATH | Va | m/s | 0.12 | 0.60 | 0.20 |
| REVERSE FLOW VELOCITY OF Ar | Vb | m/s | 0.35 | 0.35 | 0.35 |
| DETERMINATION | | | NG | OK | NG |

FIG. 9

VACUUM PUMP, STATOR COLUMN, BASE, AND EXHAUST SYSTEM OF VACUUM PUMP

CROSS-REFERENCE OF RELATED APPLICATION

This application is a Section 371 National Stage Application of International Application No. PCT/JP2019/023435, filed Jun. 13, 2019, which is incorporated by reference in its entirety and published as WO 2020/004055 A1 on Jan. 2, 2020 and which claims priority of Japanese Application No. 2018-121763, filed Jun. 27, 2018.

BACKGROUND

The present invention relates to a vacuum pump, a stator column of the vacuum pump, a base, and an exhaust system of the vacuum pump, and more particularly to a structure for measuring the temperature of a rotating portion of the vacuum pump accurately and at low cost.

An exhaust system of a vacuum pump exhausts the vacuum pump by rotating a rotating portion of the vacuum pump at high speed. Since the rotating portion of the vacuum pump is continuously rotated at high speed, in some cases the temperature thereof reaches a high temperature exceeding 100 degrees. Further rotating the rotating portion continuously at high speed when the temperature of the rotating portion is high could cause creep, which creates a problem in durability of the rotating portion.

From the perspective of preventing such creep state in advance, the temperature of the rotating portion needs to be measured and monitored. Furthermore, since the rotating portion rotates at high speed, the temperature of the rotating portion needs to be measured using a non-contact type temperature sensor (temperature sensor unit).

FIG. 10 is a diagram for explaining an exhaust system 2000 of a conventional vacuum pump.

In the vacuum pump provided in the exhaust system 2000 of the conventional vacuum pump, the temperature of an inner diameter portion of a rotating cylindrical body 10 is measured by a temperature sensor unit 2019 disposed at an outer diameter portion on the downstream side of a stator column 2020.

The discussion above is merely provided for general background information and is not intended to be used as an aid in determining the scope of the claimed subject matter. The claimed subject matter is not limited to implementations that solve any or all disadvantages noted in the background.

SUMMARY

WO2010/021307 describes a method for estimating the temperature of rotor blades (rotating portion) from the difference between the temperatures measured by a plurality of temperature sensors. More specifically, WO2010/021307 discloses a method of installing temperature sensors in two locations in a purge gas flow path formed on the inside of the rotor blades of the vacuum pump (turbomolecular pump) and estimating the temperatures of the rotor blades from the temperature difference caused by the amount of heat transmitted through the purge gas. For this measurement method, it is preferred that the atmosphere around the temperature sensors be 100% purge gas in order to accurately measure the temperatures.

The flow rate of the purge gas is generally approximately 20 sccm (20 cc per minute), the speed at which the purge gas flows (flow velocity) is small. For example, in a case where the inner diameter of the rotor blades is 200 mm, the width of the purge gas flow path is 5 mm, and the pressure is 2 Torr, the average speed of the purge gas is as extremely slow as approximately 4 cm per second.

Therefore, in a case where a process gas with poor heat conduction such as the one used in a semiconductor manufacturing apparatus flows backward, the purge gas cannot push (push back) the process gas. As a result, the process gas may get mixed in around the temperature sensors.

In this case, changing the composition of the gas results in increased measurement errors by the temperature sensors.

On the other hand, instead of exhausting a large amount of gas in the vacuum pump such as when manufacturing a semiconductor as described above, in a case where the flow rate of the gas is extremely low such as in a deposition process, the pressure of the gas around the temperature sensors is low.

In such a case, the constant low pressure of the purge gas around the temperature sensors results in creating an intermediate flow or molecular flow rather than a desired viscous flow. This results in transmission of an insufficient amount of heat and increased measurement errors of the temperature sensors.

Japanese Patent Application Publication No. H11-37087 describes a technique that increases the radiation rates of both the rotor blades to be measured and heat receiving portions of the temperature sensors by means of coating, so as to obtain the amount of heat to be transmitted even when the flow rate of the gas is low and therefore the gas pressure is low.

However, although the temperature of the rotor blades rises up to a maximum of approximately 150° C., a sufficient amount of heat cannot be obtained by radiation heat transfer alone. As a result, the measurement accuracy of the temperature sensors becomes low.

Japanese Patent No. 3201348 describes a technique that provides a small gap between a lower end of the rotor blades and a stator portion and prevents the entry of a process gas in the vicinity of bearings by supplying a purge gas to the space.

However, this technique is merely intended to prevent the process gas from entering the vicinity of the bearings and does not mention anything about managing the gas components around the temperature sensors or improving the accuracy of the temperature sensors.

Incidentally, in supplying the purge gas, a certain amount of purge gas needs to be supplied continuously from a purge gas supply device. The price of the gas itself that needs to be purchased and the running cost of supplying and controlling the gas have been a burden on the users.

Therefore, an object of the present invention is to realize a vacuum pump for accurately measuring the temperature of a rotating portion (rotor blades), a stator column of the vacuum pump, a base, and an exhaust system of the vacuum pump at low cost.

An invention according to claim 1 is a vacuum pump that receives supply of a purge gas from a purge gas supply device connected thereto and has a temperature sensor unit disposed in a purge gas flow path for the supplied purge gas, the temperature sensor unit measuring a temperature of a rotating portion, wherein a thread groove-type seal for causing at least some of the purge gas to flow back toward the temperature sensor unit is provided on a downstream side of the purge gas flow path in which the temperature sensor unit is disposed.

An invention according to claim 2 provides the vacuum pump according to claim 1, comprising a stator column that accommodates an electrical unit for rotating the rotating portion, and a base for fixing the stator column, wherein the stator column includes a throttle portion provided in at least a part of the purge gas flow path at a downstream side of the temperature sensor unit, the throttle portion having an outer diameter larger than the base and controlling the purge gas flow path in one direction.

An invention according to claim 3 provides the vacuum pump according to claim 1, comprising a stator column that accommodates an electrical unit for rotating the rotating portion, and a base for fixing the stator column, wherein the base includes a throttle portion provided in at least a part of the purge gas flow path at a downstream side of the temperature sensor unit, the throttle portion having an outer diameter larger than the stator column and controlling the purge gas flow path in one direction.

An invention according to claim 4 provides a stator column of the vacuum pump according to claim 1, wherein the stator column accommodates an electrical unit for rotating the rotating portion, and comprises either one or both of the thread groove-type seal and the throttle portion that controls the purge gas flow path in one direction.

An invention according to claim 5 provides a base of the vacuum pump according to claim 1, wherein the base fixes a stator column that accommodates an electrical unit for rotating the rotating portion, and comprises either one or both of the thread groove-type seal and the throttle portion that controls the purge gas flow path in one direction.

An invention according to claim 6 provides an exhaust system of a vacuum pump, comprising: a vacuum pump that has a temperature sensor unit disposed in a purge gas flow path to measure a temperature of a rotating portion, and has a thread groove-type seal for causing at least some of purge gas to flow back toward the temperature sensor unit, the thread groove-type seal being provided on a downstream side of the purge gas flow path in which the temperature sensor unit is disposed; a purge gas storage device for storing the purge gas used in the vacuum pump; and a purge gas supply device for supplying the purge gas stored in the purge gas storage device to the vacuum pump, wherein the exhaust system supplies the vacuum pump with the purge gas that satisfies either one of the following conditions at least when the temperature sensor unit measures the temperature of the rotating portion: a flow velocity of the purge gas is higher than a flow velocity of an exhaust gas flowing backward in at least a part downstream of the temperature sensor unit, the exhaust gas being exhausted in the vacuum pump; and pressure of the purge gas around the temperature sensor unit creates an intermediate flow or a viscous flow.

According to the present invention, the temperature of the rotating portion (rotor blades) can be measured accurately and at low cost by adjusting the purge gas that is supplied when the temperature is measured.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

FIG. 9 is a diagram for explaining a reverse flow velocity according to the embodiments of the present invention.

DETAILED DESCRIPTION

According to the present embodiment, in an exhaust system of a vacuum pump, the vacuum pump has a purge gas adjustment mechanism capable of adjusting the flow rate of a purge gas in such a manner the followings (1) to (3):

(1) At least when measuring the temperature of a rotating portion, the purge gas is supplied in an amount that makes the flow velocity of a gas flowing backward higher than the flow velocity of the purge gas, around a temperature sensor unit.

(2) At least when measuring the temperature of the rotating portion, the purge gas is supplied in an amount that makes the pressure of the gas around the temperature sensor unit create an intermediate flow (intermediate flow region) or a viscous flow (viscous flow region).

Furthermore, the exhaust system of the vacuum pump according to the present embodiment includes a purge gas supply device as a purge gas flow rate control means for introducing the purge gas to the vacuum pump, the purge gas supply device being capable of controlling the flow rate of the purge gas.

(3) A thread groove-type seal is provided on the downstream side of a purge gas flow path in which the temperature sensor unit is provided, to cause a certain amount of purge gas to flow back toward the temperature sensor unit.

According to this configuration, in the present embodiment, not only is it possible to prevent a change in the composition of components by preventing process gas from flowing backwards around the temperature sensor unit at the time of temperature measurement, but also the amount (flow rate) of the purge gas to be supplied from the purge gas supply device can be reduced. Therefore, the temperature of the rotating portion can be measured accurately and at low cost.

Preferred embodiments of the present invention are now described hereinafter in detail with reference to FIGS. 1 to 9.

Configuration of Exhaust System 1000

Figure 1:
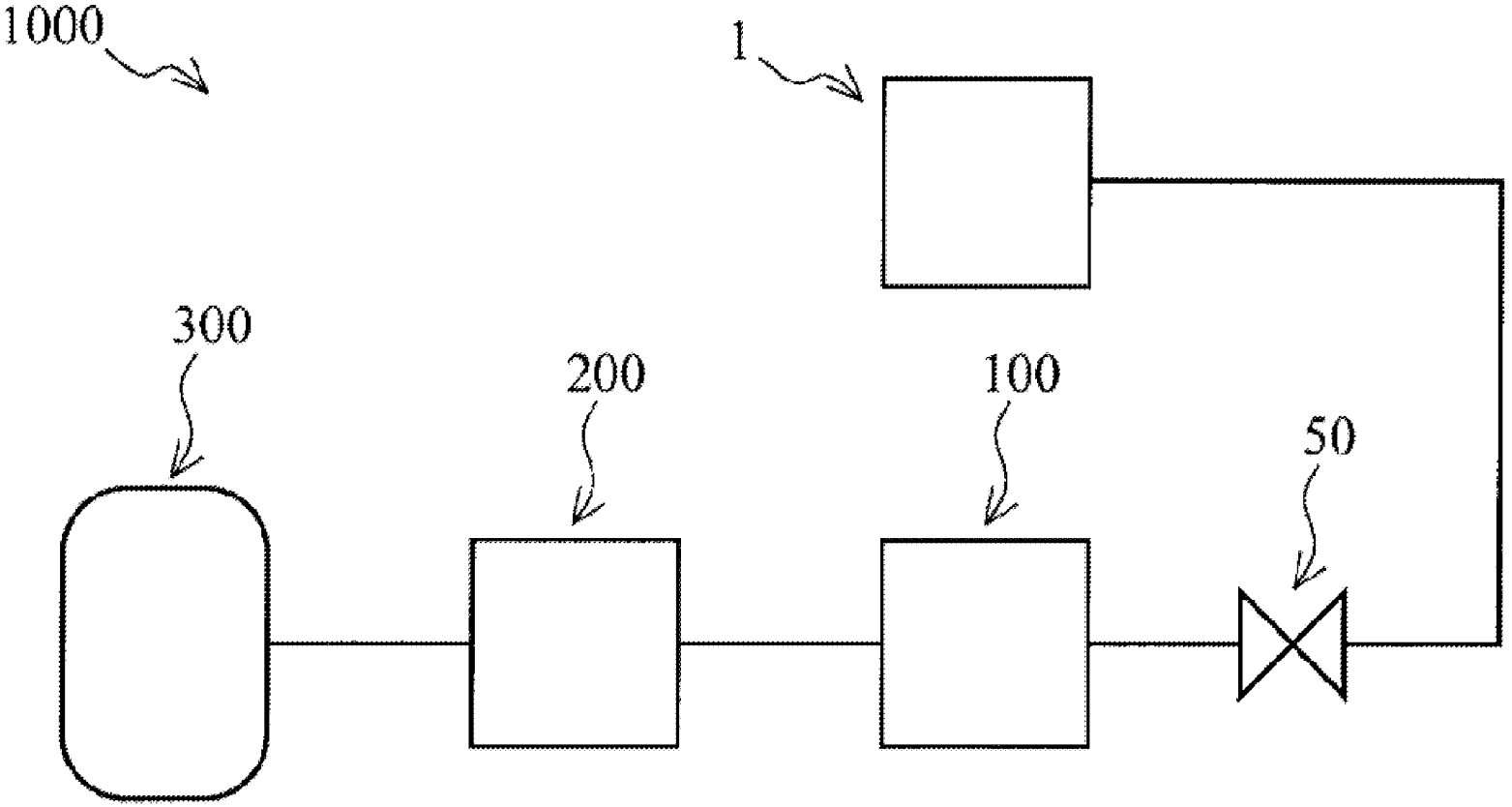
FIG. 1 is a diagram for explaining an exhaust system of a vacuum pump according to each embodiment of the present invention.

FIG. 1 is a diagram for explaining an exhaust system 1000 of a vacuum pump according to an embodiment of the present invention.

The exhaust system 1000 of a vacuum pump is configured by a vacuum pump 1, a purge gas supply device 100, a regulator 200, and a gas cylinder 300.

The configuration of the vacuum pump 1 will be described hereinafter.

The purge gas supply device 100 is a flow rate adjusting device that controls the flow rate of the purge gas so that the amount of purge gas supplied to the vacuum pump 1 becomes an appropriate amount. The purge gas supply device 100 is connected to a purge port of the vacuum pump 1 (referred to as "purge port 18" hereinafter) via a valve 50.

The purge gas described herein is an inert gas such as nitrogen gas ($N_2$) or argon gas (Ar). By supplying such purge gas to an electrical component storage unit, electrical components are protected from corrosive gas (gas used as the process gas) that is likely to be contained in a gas exhausted from a vacuum case to which the vacuum pump 1 is connected.

In the following embodiments, a nitrogen gas, which has relatively good thermal conductivity and is inexpensive, will be described as an example of the purge gas.

The regulator 200 is a device for lowering the pressure of the gas sent from the gas cylinder 300 to an easy-to-use atmospheric pressure.

The gas cylinder 300 is a device in which is stored the nitrogen gas, which is the purge gas according to the present embodiment.

Configuration of Vacuum Pump 1

The configuration of the vacuum pump 1 disposed in the exhaust system 1000 is described next.

Figure 2:
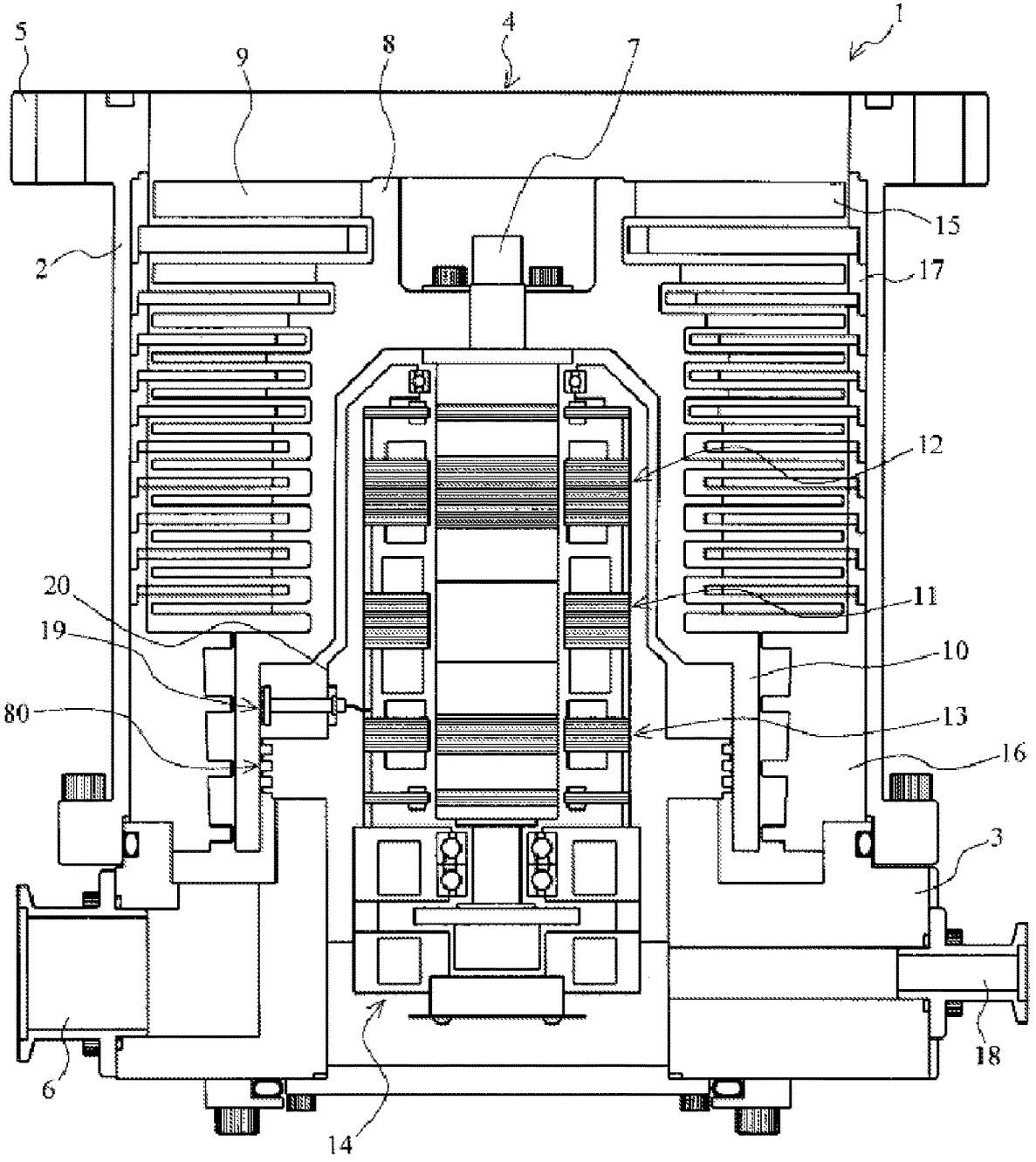
FIG. 2 is a diagram showing a schematic configuration example of a vacuum pump according to Embodiment 1 of the present invention.

FIG. 2 is a diagram for explaining the vacuum pump 1 according to Embodiment 1 of the present invention, and is a diagram showing a cross section taken along an axial direction of the vacuum pump 1.

The vacuum pump 1 of the present embodiment is a so-called composite type molecular pump that includes a turbomolecular pump unit and a thread groove pump unit.

A casing 2 that forms a housing of the vacuum pump 1 is in a substantially cylindrical shape and configures a frame of the vacuum pump 1 together with a base 3 provided at a lower portion of the casing 2 (an outlet port 6 side). Also, a gas transfer mechanism, a structure for achieving an exhaust function of the vacuum pump 1, is housed in the frame of the vacuum pump 1.

The gas transfer mechanism is mainly composed of a rotating portion supported in a rotatable manner, and a stator portion fixed to the frame of the vacuum pump 1.

An inlet port 4 for introducing a gas into the vacuum pump 1 is formed at an end of the casing 2. Also, a flange portion 5 protruding toward an outer periphery of the vacuum pump 1 is formed on an end surface of the casing 2 at the inlet port 4 side.

The outlet port 6 for exhausting the gas into the vacuum pump 1 is formed in the base 3.

The rotating portion is composed of a shaft 7 which is a rotating shaft, a rotor 8 disposed on the shaft 7, a plurality of rotor blades 9 (the inlet port 4 side) and a rotating cylindrical body 10 (the outlet port 6 side) that are provided on the rotor 8, and the like. Note that a rotating portion is configured by the shaft 7 and the rotor 8.

The rotor blades 9 consist of a plurality of blades that are inclined by a predetermined angle from a plane perpendicular to an axis of the shaft 7 and extend radially from the shaft 7.

In addition, the rotating cylindrical body 10, located on the downstream side of the rotor blades 9, is configured from a cylindrical member having a shape of a cylinder concentric with a rotation axis of the rotor 8. In the present embodiment, the downstream side of the rotating cylindrical body 10 is a measurement target, the temperature of which is measured by a temperature sensor unit 19 to be described hereinafter.

A motor portion 11 for rotating the shaft 7 at high speed is provided in the middle of an axial direction of the shaft 7.

Furthermore, radial magnetic bearing devices 12, 13 for supporting the shaft 7 in a radial direction in a non-contact manner are provided on the inlet port 4 side and the outlet port 6 side with respect to the motor portion 11 of the shaft 7, respectively, and an axial magnetic bearing device 14 for supporting the shaft 7 in the axial direction in a non-contact manner is provided at a lower end of the shaft 7, the radial magnetic bearing devices 12, 13 and the axial magnetic bearing device 14 being enclosed in a stator column 20.

The temperature sensor unit 19 for measuring the temperature of the rotating portion is disposed in an outer diameter portion of the stator column 20, at the outlet port 6 side.

The temperature sensor unit 19 is composed of a disc-shaped heat receiving portion (i.e., a temperature sensor portion), a mounting portion fixed to the stator column 20, and a cylindrical heat insulating portion connecting the heat receiving portion and the mounting portion. It is preferred that the cross-sectional area of the heat receiving portion be made as wide as possible for the purpose of detecting heat transferred from the rotating cylindrical body 10 (rotating portion) which is the measurement target. The heat receiving portion is also disposed in such a manner as to face the rotating cylindrical body 10, with a gap therebetween.

In the present embodiment, the heat receiving portion is made of aluminum, and the heat insulating portion is made of a resin. However, the materials of the heat receiving portion and the heat insulating portion are not limited thereto; the heat receiving portion and the heat insulating portion may be formed integrally with a resin.

Further, a second temperature sensor portion may be disposed in the heat insulating portion, the mounting portion, or the stator column 20, and the temperature of the measurement target (the rotating portion) may be estimated using the difference between the temperature obtained by the second temperature sensor portion and the temperature obtained by the temperature sensor portion disposed in the heat receiving portion (the first temperature sensor portion).

The stator portion (fixed cylindrical portion) is formed on the inner peripheral side of the frame (the casing 2) of the vacuum pump 1. The stator portion is composed of stator blades 15 provided at the inlet port 4 side (turbomolecular pump unit), a thread groove spacer 16 (thread groove pump unit) provided on an inner peripheral surface of the casing 2, and the like.

The stator blades 15 consist of blades extending from the inner peripheral surface of the frame of the vacuum pump 1 toward the shaft 7 and inclined by a predetermined angle from a plane perpendicular to the axis of the shaft 7.

The stator blades 15 of the respective stages are separated from each other by cylindrical spacers 17.

In the vacuum pump 1, the stator blades 15 are formed in a plurality of stages in the axial direction, alternating with the rotor blades 9.

Spiral grooves are formed on a surface of the thread groove spacer 16 that faces the rotating cylindrical body 10. The thread groove spacer 16 is configured to face an outer peripheral surface of the rotating cylindrical body 10, with a predetermined clearance (gap) therebetween. The direction of the spiral grooves formed on the thread groove spacer 16 is a direction in which the gas flows toward the outlet port 6 when transported through the spiral grooves in the rotation direction of the rotor 8. Note that the spiral grooves may be provided on at least either the surface of the thread groove spacer 16 that faces the rotating portion or the surface of the same that faces the stator portion.

In addition, the depth of the spiral grooves becomes shallow toward the outlet port 6, so that the gas transported through the spiral grooves is compressed gradually as the gas approaches the outlet port 6.

A thread groove-type seal 80 provided in the present embodiment is described next.

As shown in FIG. 2, the thread groove-type seal 80 is a spiral groove formed on a side surface of the stator column 20, at the downstream side of the temperature sensor unit 19 installed in the purge gas flow path.

Figure 3:
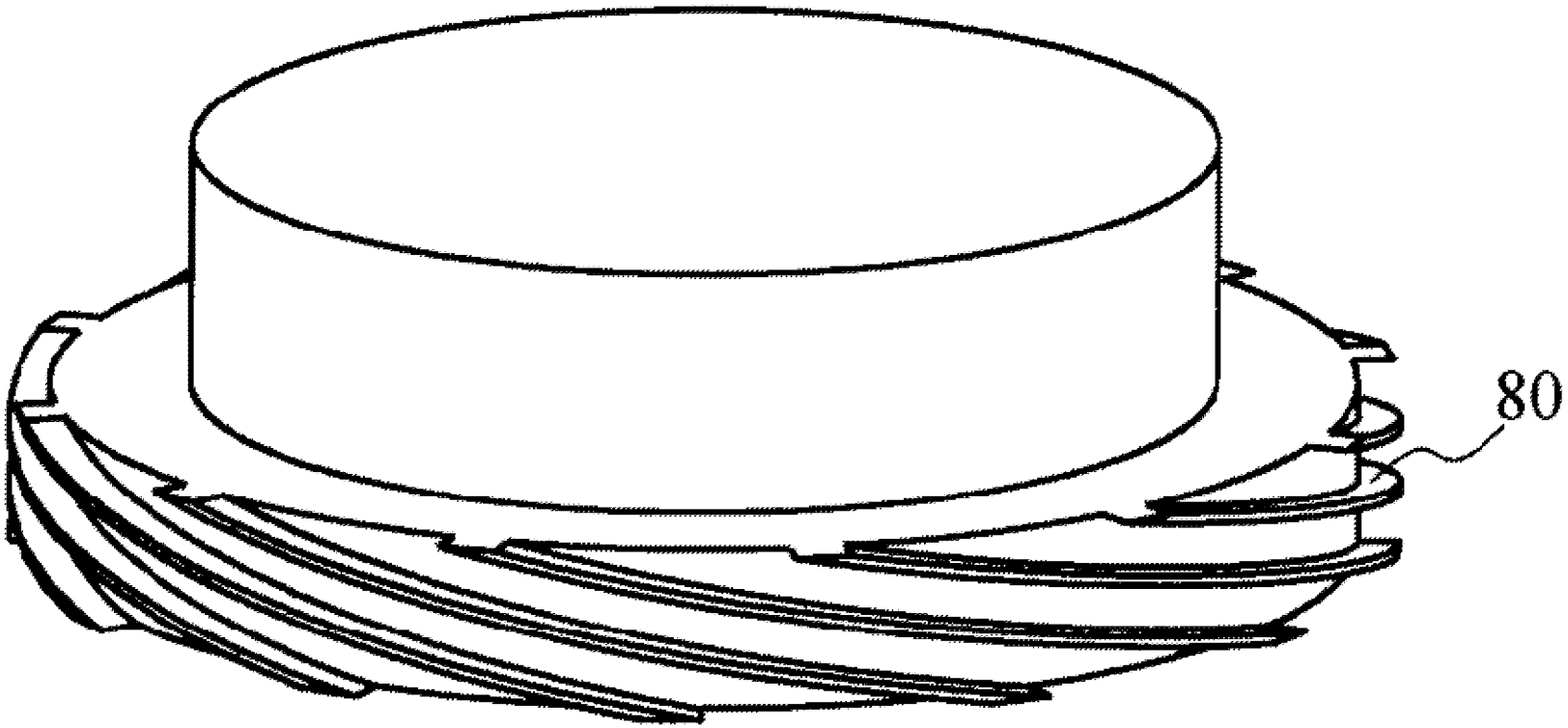
FIG. 3 is a perspective view of a thread groove-type seal according to an embodiment of the present invention.

FIG. 3 shows a perspective view of the appearance of the thread groove-type seal 80. The direction of the grooves of the thread groove-type seal 80 is a direction in which the purge gas is returned toward the temperature sensor unit 19 when the rotating portion is rotated at high speed. Specifically, the grooves are formed in the direction opposite to that of the thread grooves provided in a typical exhaust system.

Therefore, the thread groove-type seal 80 functions to return the purge gas toward the temperature sensor unit 19. Accordingly, the pressure around the temperature sensor unit 19 can be increased more.

With a smaller amount of purge gas, the thread groove-type seal 80 can cause the gas pressure around the temperature sensor unit 19 to make an intermediate flow (intermediate flow region) or a viscous flow (viscous flow region). Therefore, the total amount of purge gas to be supplied can be saved, resulting in cost reduction.

Moreover, since the gas pressure around the temperature sensor unit 19 can be caused to make an intermediate flow (intermediate flow region) or a viscous flow (viscous flow region) by the thread groove-type seal 80, sufficient heat exchange can take place between the rotor blades 9 and the temperature sensor unit 19, thereby realizing more accurate temperature measurement.

Since a small amount of gas flows through the thread groove-type seal 80 shown in FIG. 3, the depth of the thread grooves of the thread groove-type seal 80 may be shallow. Also, the angle of the thread is preferably approximately 10 degrees (approximately 15 to 20 degrees in case of an exhaust element), so that sealing can be achieved even if the axial length is short.

Furthermore, the thread groove-type seal 80 may be created as a separate part instead of being formed directly on the outer periphery of the stator column 20, and this separately created part may be stuck to the outer periphery of the stator column 20 by means of press-fitting or bolting in such a manner that the gas does not escape.

Further, the purge port 18 is provided on an outer peripheral surface of the base 3. The purge port 18 communicates with an internal region of the base 3 (i.e., electrical component storage unit) via the purge gas flow path. The purge gas flow path is a lateral through-hole penetrating radially from an outer peripheral wall surface of the base 3 to an inner peripheral wall surface of the same, and functions as a purge gas supply path for sending the purge gas supplied from the purge port 18, to the electrical component storage unit.

Note that the purge port 18 is connected to the purge gas supply device 100 via the valve 50, as shown in FIG. 1.

How the purge gas flows is now described. The purge gas supplied from the purge port 18 is introduced into the base 3 and the stator column 20. The purge gas then moves toward the upper side of the shaft 7 through the motor portion 11, the radial magnetic bearing devices 12, 13, the rotor 8, and the stator column 20. The purge gas is further sent to the outlet port 6 through between the stator column 20 and an inner peripheral surface of the rotor 8, and discharged to the outside of the vacuum pump 1 from the outlet port 6 together with the gas taken in from the inlet port 4 (the gas used as the process gas).

According to the vacuum pump 1 configured as described above, vacuum exhaust treatment is performed in a vacuum chamber (vacuum case), not shown, which is disposed in the vacuum pump 1. The vacuum chamber is a vacuum device used as, for example, a chamber or the like for a surface analyzer or a microfabrication apparatus.

A second embodiment is described next with reference to FIG. 4.

In the second embodiment, in addition to the thread groove-type seal 80 provided in the first embodiment, a protruding outer diameter portion 21 that configures a throttle portion is provided as a purge gas adjustment mechanism, on the upstream side of the thread groove-type seal 80. The throttle portion controls the flow of the gas in such a manner that the gas flows only in one direction.

There is a risk that the thread groove-type seal 80 provided in the first embodiment sends not only the purge gas but also the process gas sucked in by the vacuum pump 1, toward the temperature sensor unit 19. As a result, the area around the temperature sensor unit 19 becomes filled with a mixed gas of the purge gas and the process gas. Such mixing of the gases changes the physical properties of the purge gas such as the thermal conductivity thereof, making it difficult to measure the temperature accurately.

Therefore, in order to prevent mixing of the gases, the throttle portion for controlling the flow of the purge gas in such a manner that the purge gas flows in one direction is provided in addition to the thread groove-type seal 80. The throttle portion will be described hereinafter in more detail.

A third embodiment is described next with reference to FIG. 5.

Unlike the second embodiment, in the third embodiment, the protruding outer diameter portion 21 that configures the throttle portion is provided as the purge gas adjustment mechanism, on the downstream side of the thread groove-type seal 80.

The lower the pressure, the higher the flow velocity of the purge gas in the throttle portion. Thus, it is preferred that the throttle portion be provided on the downstream side of the thread groove-type seal 80 as in the third embodiment.

A fourth embodiment is described next with reference to FIG. 6.

Unlike the second and third embodiments, in the fourth embodiment, a large outer diameter portion 31 (throttle portion) is disposed on the base 3, as the purge gas adjustment mechanism capable of adjusting the flow rate of the purge gas. That is, while the thread groove-type seal 80 and the protruding outer diameter portion 21 (throttle portion) are disposed in the same part, i.e., the stator column 20 in the second and third embodiments, the thread groove-type seal 80 and the throttle portion are provided in separate parts in the fourth embodiment. Therefore, the fourth embodiment has an advantage such as easy processing.

Figure 6:
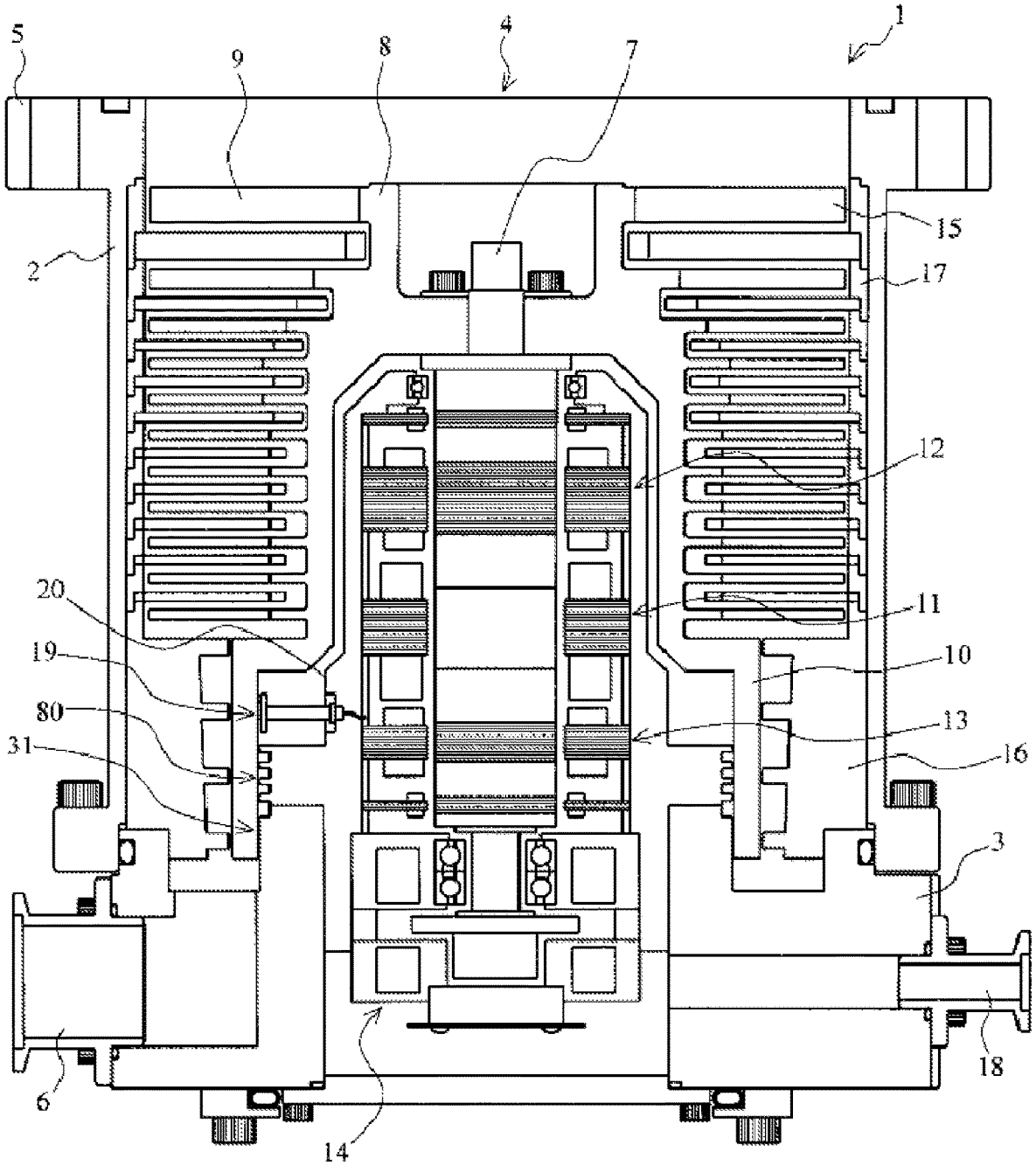
FIG. 6 is a diagram showing a schematic configuration example of a vacuum pump according to Embodiment 4 of the present invention.

Also, as is apparent from FIG. 6, the thread groove-type seal 80 may be provided on the base 3. Specifically, the thread groove-type seal 80 can be provided on the stator column 20 or the base 3.

The throttle portion can also be provided on the stator column 20 or the base 3.

The purge gas adjustment mechanism that is provided in the vacuum pump 1 having the above-described configuration is described next.

For the purge gas adjustment mechanism provided in the vacuum pump 1, two examples are described as a configuration for adjusting the flow velocity of the purge gas, and one example is described as a configuration for adjusting the pressure of the purge gas.

Figure 4:
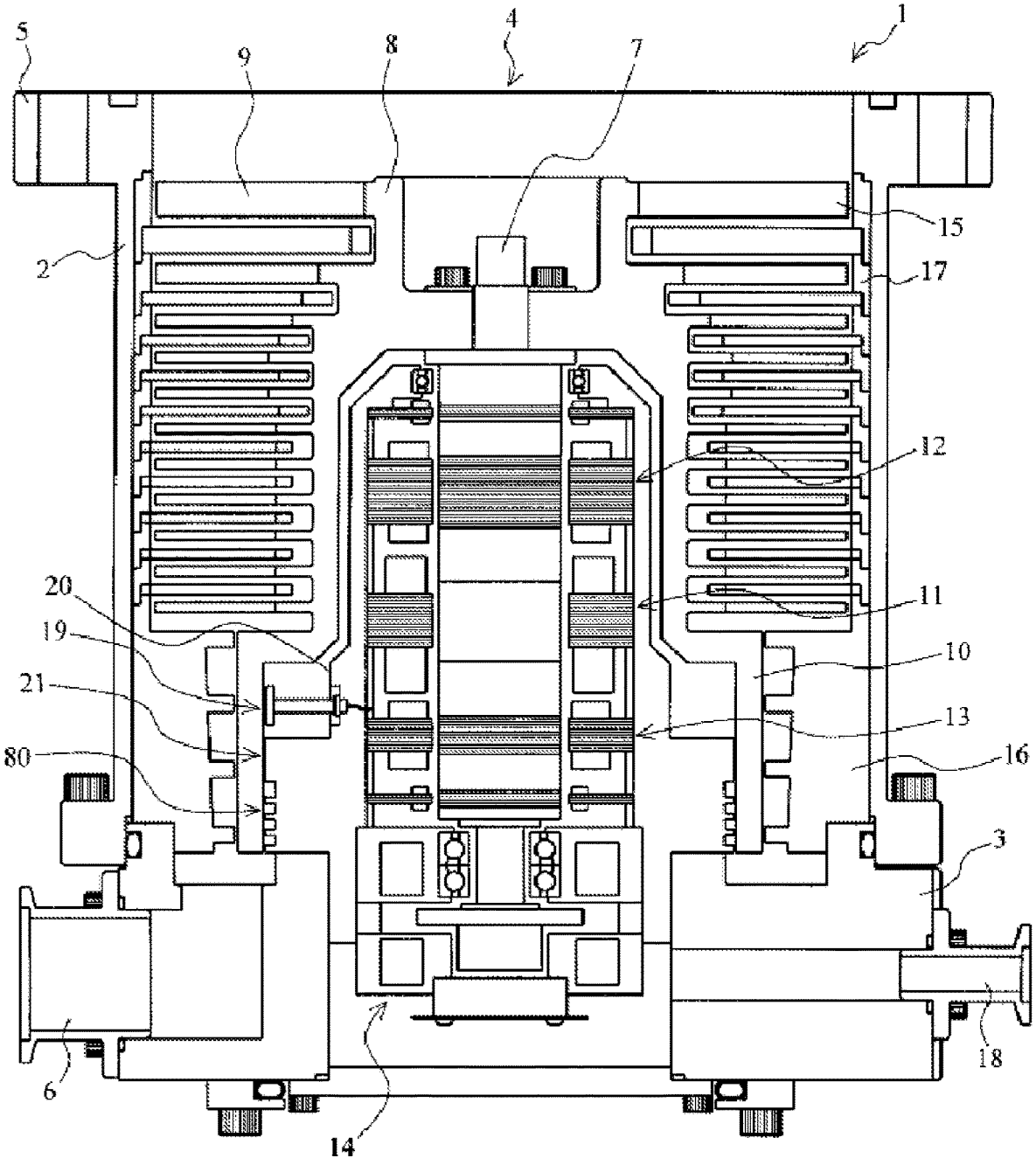
FIG. 4 is a diagram showing a schematic configuration example of a vacuum pump according to Embodiment 2 of the present invention.
Figure 5:
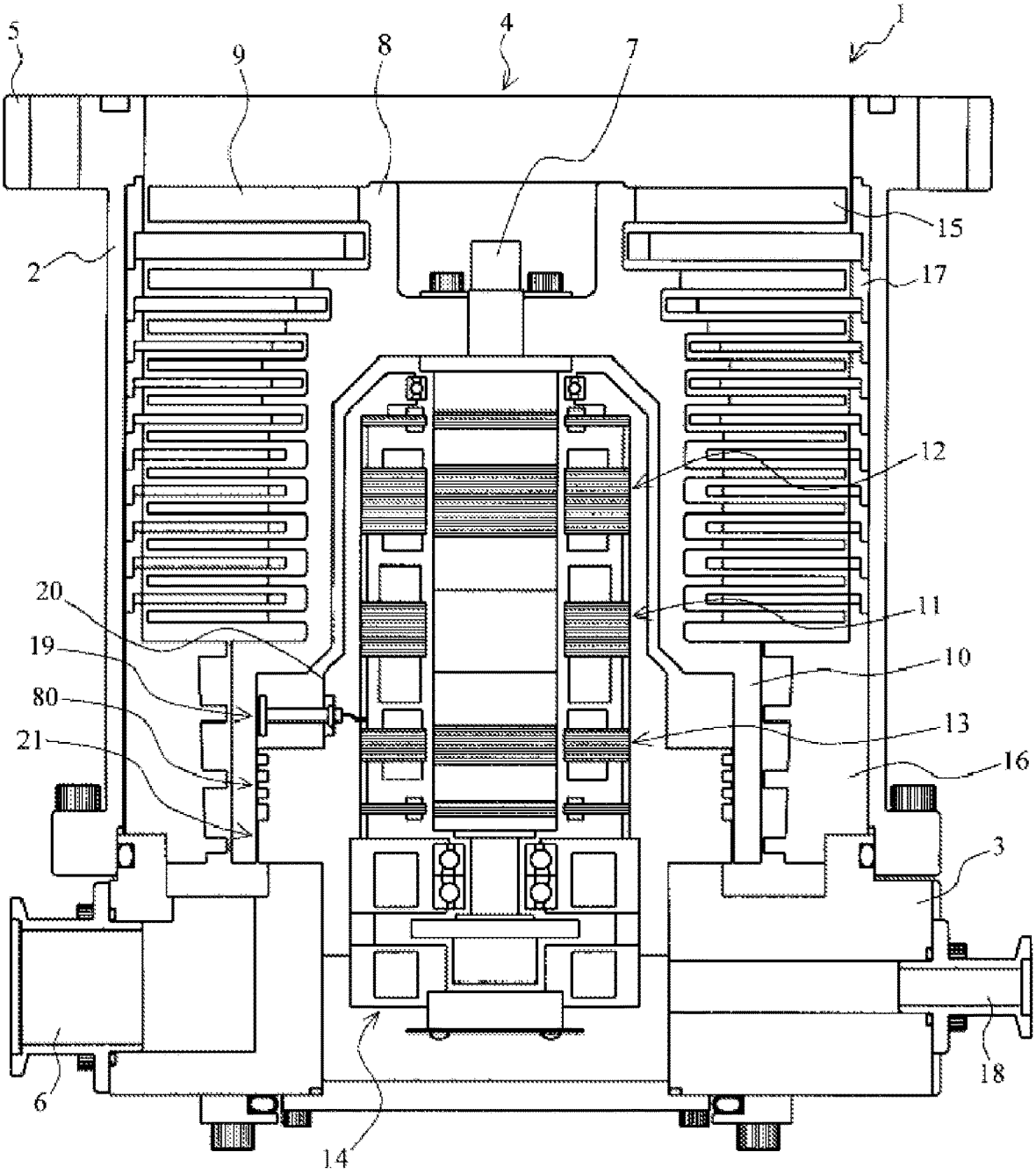
FIG. 5 is a diagram showing a schematic configuration example of a vacuum pump according to Embodiment 3 of the present invention.

In the vacuum pump 1 according to Embodiment 2 and Embodiment 3 shown in FIGS. 4 and 5, the protruding outer diameter portion 21 (throttle portion) is disposed on the stator column 20 as the purge gas adjustment mechanism capable of adjusting the flow rate of the purge gas.

The protruding outer diameter portion 21 is formed at least on a part of the stator column 20 that is located at the downstream side (the outlet port 6 side) thereof where the temperature sensor unit 19 is disposed, by increasing the outer diameter of said stator column 20.

By forming the protruding outer diameter portion 21 by partially expanding the outer diameter of the stator column 20, the purge gas flow path formed by the protruding outer diameter portion 21 and the rotating cylindrical body 10 facing each other becomes narrow. Note that the purge gas flow path is a gap configured by an inner diameter surface of the rotating cylindrical body 10 and an outer diameter surface of the protruding outer diameter portion 21.

By reducing the cross-sectional area of the purge gas flow path while the volume of the flowing purge gas is constant, the flow velocity of the purge gas becomes faster accordingly. The backflow (reverse diffusion) of the exhaust gas to the periphery of the temperature sensor unit 19 can be prevented by increasing the flow velocity of the purge gas to a flow velocity higher than that of the exhaust gas (process gas) diffusing backwards.

Note that the protruding outer diameter portion 21 (throttle portion) is preferably formed only on a part of the stator column 20. More specifically, the axial length of the purge gas flow path of the protruding outer diameter portion 21 is preferably a maximum of approximately 30 mm.

Further, the width of a part of the purge gas flow path where the throttle portion is disposed is preferably as narrow as possible within a range in which the rotating cylindrical body 10 (rotating portion) and the stator column 20 (stator portion) do not come into contact with each other during the operation of the vacuum pump 1, and it is preferred that said width be equal to or less than 1.0 mm.

According to this configuration, the viscous resistance between the rotating cylindrical body 10 and the stator column 20 is reduced, thereby preventing the increase in power consumption and heat generation.

Moreover, the configuration in which the exhaust gas is pushed back by the purge gas at the downstream side of the temperature sensor unit 19 can prevent the increase in measurement error which can be caused when the process gas that is being exhausted in the vacuum pump 1 flows back to the periphery of the temperature sensor unit 19 and thereby the gas components around the temperature sensor unit 19 change.

Other embodiments of the throttle portion are described using FIG. 6.

In the vacuum pump 1 according to Embodiment 4, as the purge gas adjustment mechanism capable of adjusting the flow rate of the purge gas, the large outer diameter portion 31 (throttle portion) is disposed on the base 3.

In the base 3, the large outer diameter portion 31 is formed at least at a part downstream from the position in the stator column 20 where the temperature sensor unit 19 is disposed (the outlet port 6 side), by increasing the outer diameter of the base 3.

As a result of forming the large outer diameter portion 31 by partially expanding the outer diameter of the base 3, the purge gas flow path formed by the large outer diameter portion 31 and the rotating cylindrical body 10 facing each other becomes narrow. By reducing the cross-sectional area of the purge gas flow path while the volume of the flowing purge gas is constant, the flow velocity of the purge gas becomes faster as in Embodiments 2 and 3. The backflow of the exhaust gas to the periphery of the temperature sensor unit 19 can be prevented by increasing the flow velocity of the purge gas to a flow velocity higher than that of the exhaust gas diffusing backwards.

Note that the large outer diameter portion 31 (throttle portion) is preferably formed only in a part of the base 3. More specifically, the axial length of the purge gas flow path of the large outer diameter portion 31 is preferably a maximum of approximately 30 mm.

Further, the width of a part of the purge gas flow path where the throttle portion is disposed is preferably as narrow as possible within a range in which the rotating cylindrical body 10 (rotating portion) and the base 3 (stator portion) do not come into contact with each other during the operation of the vacuum pump 1, and it is preferred that said width be equal to or less than 1.0 mm.

According to this configuration, the viscous resistance between the rotating cylindrical body 10 and the base 30 is reduced, thereby preventing the increase in power consumption and heat generation.

Moreover, the configuration in which the exhaust gas is pushed back by the purge gas at the downstream side of the temperature sensor unit 19 can prevent the increase in measurement error which can be caused when the process gas that is being exhausted in the vacuum pump 1 flows back to the periphery of the temperature sensor unit 19 and thereby the gas components around the temperature sensor unit 19 change.

As in Embodiment 3 described above, the cross-sectional area of the purge gas flow path can be reduced (i.e., narrowed down) by disposing the throttle portion (the protruding outer diameter portion 21) on the downstream side of the position of the temperature sensor unit 19 in the purge gas flow path.

Therefore, even in a case where the amount of purge gas supplied is low (such as in a deposition process), the purge gas flow rate that is required to prevent the exhaust gas from flowing back to the periphery of the temperature sensor unit 19 can be realized with the small amount of purge gas.

The purge gas adjustment mechanism for adjusting the pressure of the purge gas is described next.

In general, when the gas pressure around the temperature sensor unit 19 makes a molecular flow, the temperature transfer drops in proportion to the pressure, bringing about a risk that the temperature sensor unit 19 no longer functions.

Therefore, the purge gas adjustment mechanism according to Embodiment 2 to Embodiment 4 supplies the purge gas in an amount necessary for the gas pressure around the temperature sensor unit 19 to create a pressure region close to the viscous flow (viscous flow region) rather than the molecular flow, at least when the temperature of the rotating cylindrical body 10 is measured.

More specifically, the purge gas is supplied in an amount in which a mean free path (λ) of the purge gas is smaller than the distance between the temperature sensor unit 19 and the rotating cylindrical body 10.

Note that the mean free path is the average value of the distance in which the molecules of the purge gas can travel without having the course thereof changed by colliding with other molecules.

In this manner, the pressure around the temperature sensor unit 19 is increased to promote heat transmission by the gas. According to this configuration, the pressure within the vacuum pump 1 increases, thereby promoting heat transmission, and preventing the increase in measurement error.

Figure 7:
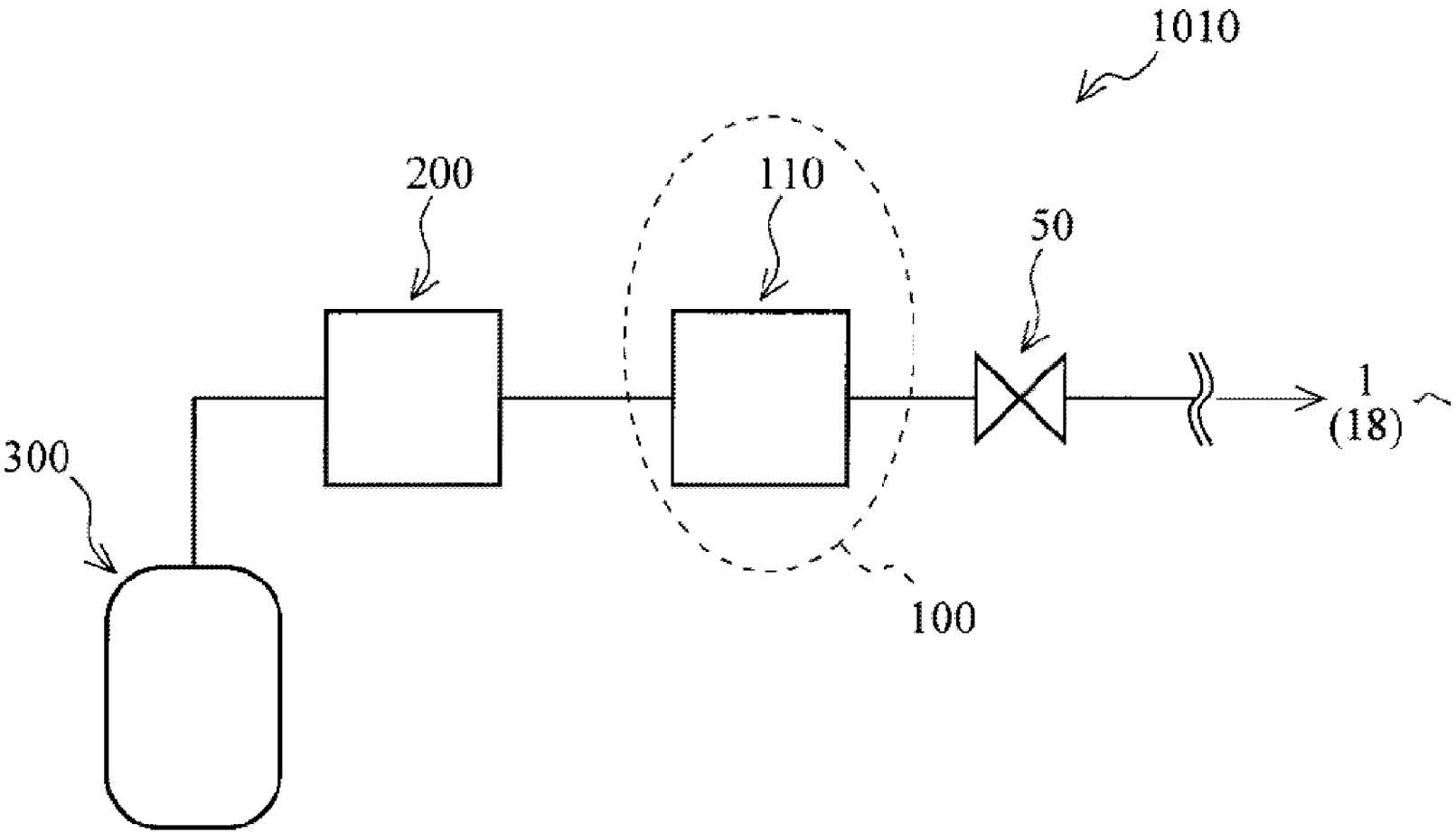
FIG. 7 is a diagram for explaining a purge gas supply device disposed in the exhaust systems of the vacuum pumps according to the embodiments of the present invention.

Another embodiment of the exhaust system 1000 according to the present invention is described specifically next with reference to FIG. 7.

FIG. 7 is a diagram for explaining the purge gas supply device 100 disposed in an exhaust system 1010 of the vacuum pump.

Continuously letting a certain amount or more of purge gas flow in order to realize Embodiments 1, 2, 3, and 4 described above leads to an increase in costs and an increase in the amount of heat generated.

Therefore, in order to reduce the flow rate of the purge gas other than when measuring the temperature using the temperature sensor unit 19, a mass flow controller 110 is provided as a purge gas flow rate control means that can set at least two gas flow rates when introducing the purge gas into the vacuum pump 1.

In the exhaust system 1010 provided with the mass flow controller 110, the flow rate of the purge gas can be increased temporarily at the time of the temperature measurement.

Since the mass flow controller 110 functions as a flow rate adjusting device for adjusting the flow rate of the purge gas, an increase in cost and an increase in the amount of heat generated that result from continuously letting a certain amount or more of purge gas flow, can be prevented.

Supplying the purge gas only during the temperature measurement performed by the temperature sensor unit 19 or increasing the amount of purge gas supplied can eventually lead to saving the total amount of purge gas supplied, contributing to cost reduction.

Yet another embodiment of the exhaust system 1000 of the present invention is specifically described with reference to FIG. 8.

Figure 8:
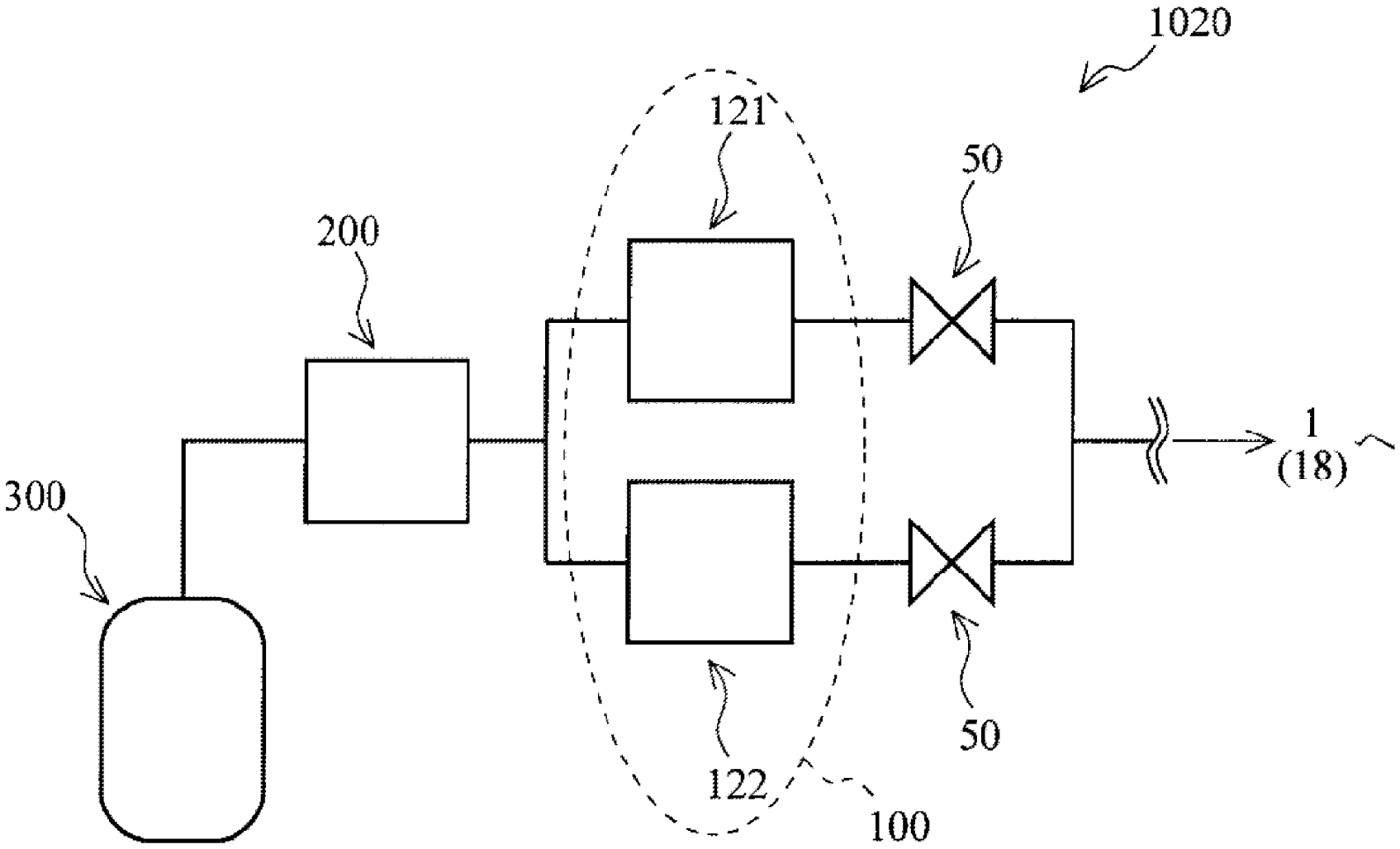
FIG. 8 is a diagram for explaining the purge gas supply device disposed in the exhaust systems of the vacuum pumps according to the embodiments of the present invention.
Figure 10:
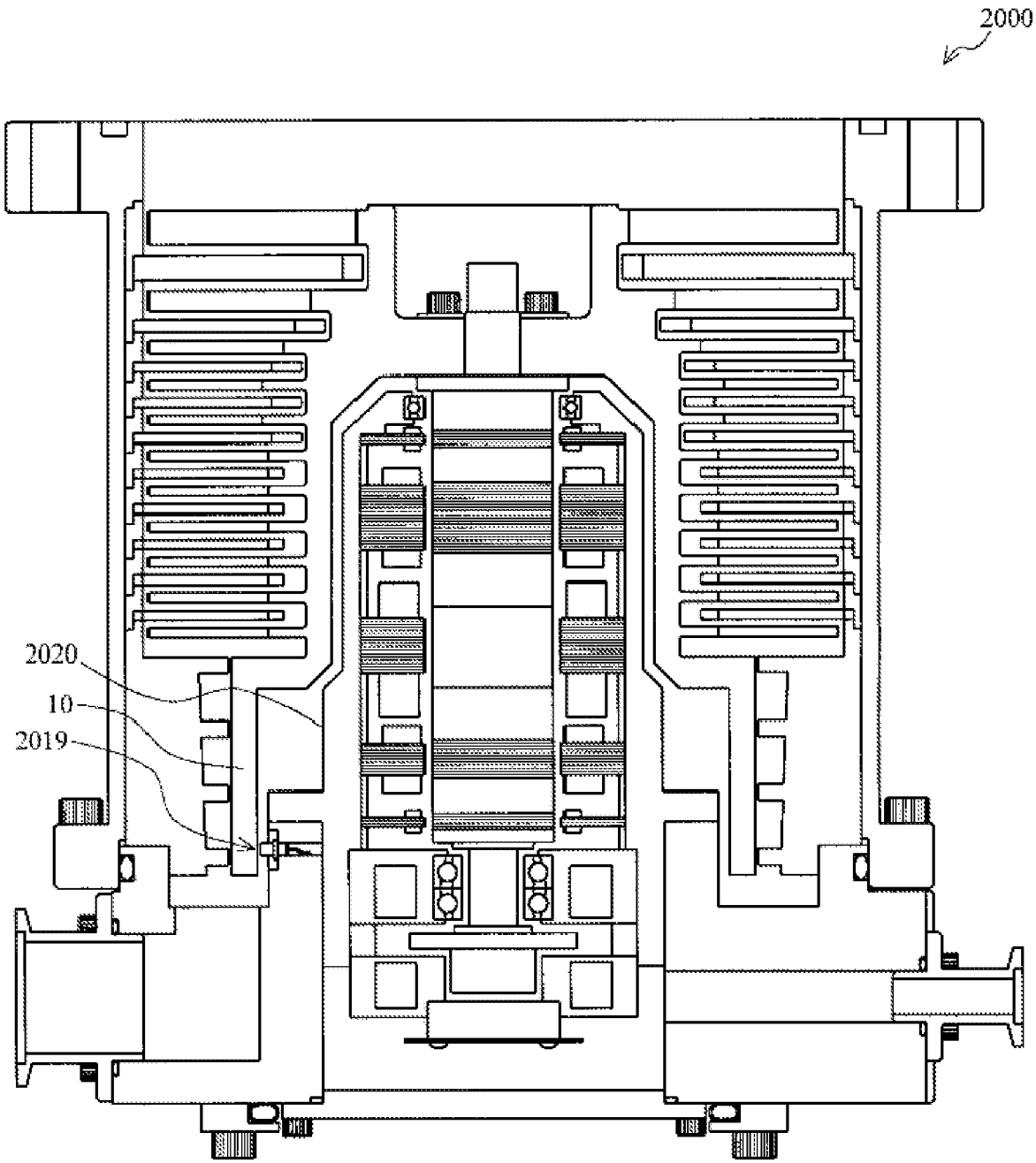
FIG. 10 is a diagram for explaining a vacuum pump according to the prior art.

FIG. 8 is a diagram for explaining the purge gas supply device 100 disposed in an exhaust system 1020 of the vacuum pump.

As shown in FIG. 8, two flow restrictors 121, 122 are disposed as the purge gas supply device 100.

Specifically, in order to reduce the flow rate of the purge gas other than when the temperature sensor unit 19 measures the temperature, the flow restrictors (121, 122) are disposed as the purge gas flow rate control means capable of changing the flow rate of the purge gas when introducing the purge gas into the vacuum pump 1.

In the exhaust system 1020 in which the flow restrictors (121, 122) are disposed, the flow rate of the purge gas can temporarily be increased at the time of the temperature measurement.

Thus, the flow restrictors (121, 122) each function as the flow rate adjusting device for adjusting the flow rate of the purge gas.

The flow restrictors (121, 122) are each a flow rate adjusting device that uses the difference in atmospheric pressure. When increasing the flow rate of the purge gas, both of the two valves 50 are opened to let the purge gas flow in parallel.

Since the flow restrictors (121, 122) each function as the flow rate adjusting device for adjusting the flow rate of the purge gas in this manner, the increase in cost and the amount of heat generated that are caused by continuously letting a certain amount or more of purge gas flow, can be prevented.

FIG. 9 is a diagram for explaining the flow velocity of the gas flowing backward.

Next is described a flow of calculations using a space 1 and a space 2 shown in FIG. 9 to figure out under what condition, theoretically, the backflow of the gas can be prevented (i.e., at what level of flow velocity of the gas flowing through the purge gas flow path the backflow of the exhaust gas can be prevented).

FIG. 9 shows the space 1 to which $N_2$ gas is introduced, the space 2 to which Ar gas is introduced, and a pile connecting the space 1 and the space 2.

Note that the space 1 corresponds to the purge gas flow path in which the temperature sensor unit 19 is disposed, the pipe corresponds to the purge gas flow path, and the space 2 corresponds to the exhaust gas flow path on the outlet port 6 side.

For the dimensions of the pipe, Do represents the outer diameter of the pipe, Di the inner diameter, and L the length.

As shown in FIG. 9, suppose that the $N_2$ gas having a flow rate of 60 sccm (0.1 $Pam^3/s$) is introduced to the space 1. At this time, as to the component ratio of the space 1, Ar gas is 0% whereas the $N_2$ gas is 100%. In addition, the flow velocity of the $N_2$ gas flowing from the space 1 to the space 2 through the pipe is expressed as Va.

On the other hand, suppose that the Ar gas having a flow rate of 1940 sccm is introduced to the space 2. The flow velocity of the Ar gas flowing from the space 2 back to the space 1 through the pipe is expressed as Vb. At this time, as to the component ratio of the space 2, $N_2$ gas is 3% whereas the Ar gas is 97%.

Thus, there exists a difference between the concentration of the Ar gas in the space 1 and the concentration of the Ar gas in the space 2.

The amount of the Ar gas flowing back into the pipe due to the concentration difference (the diffusion velocity in a steady state) can be calculated theoretically by the following equation of Fick's first law (Equation 1).

$$J=-D\times(C2-C1)/L \quad \text{(Equation 1)}$$

where J is the flow velocity ($mol/m^2s$), D the diffusion coefficient ($m^2s$), C1 the Ar gas concentration ($mol/m^3$) in the space 1, C2 the Ar gas concentration ($mol/m^3$) in the space 2, and L the distance (m).

As shown in FIG. 9, since the Ar gas in the space 1 is 0%, C1 is 0. Thus, the flow velocity (reverse flow velocity) Vb of the Ar gas moving from the space 2 to the space 1 can be calculated by the following equation 2.

$$Vb=-J/C2=\{D\times(C2-C1)/L\}/C2=D/L \quad \text{(Equation 2)}$$

In other words, the numerical value obtained by dividing the diffusion coefficient D by the distance L is Vb.

Furthermore, the diffusion coefficient D can be calculated by the following equation 3 using an average thermal velocity v and the mean free path 2 of the gas molecules.

$$D=\frac{1}{3}\times v\times\lambda \quad \text{(Equation 3)}$$

Therefore, for example, when the pressure is 266 Pa and the distance L is 0.01 m, the flow velocity of the Ar gas (reverse flow velocity) Vb=0.35 m/s is obtained as shown in the equation 4 (see calculation conditions shown in FIG. 9).

$$Vb=D/L-(\tfrac{1}{3}\times 398\times 2.6E-05)/0.01=0.35(m/s) \quad \text{(Equation 4)}$$

In other words, since Vb is 0.35 m/s, if the flow velocity of Va is higher than this Vb, the Ar gas can be prevented from flowing from the space 1 back to the space 2. Next is described the width of the flow path for making the flow velocity of Va higher than that of Vb in order to prevent the Ar gas from flowing from the space 1 back to the space 2.

A volume flow rate Qv ($m^3/s$) for letting the $N_2$ gas flow at 60 sccm (0.10 $Pam^3/s$ after unit conversion) can be calculated using the following equation 5.

$$Qv=0.10/266=3.8E-04(m^3/s) \quad \text{(Equation 5)}$$

Therefore, as will be described hereinafter with an example, by reducing the width of the flow path (reducing the cross-sectional area), "flow velocity of $N_2$ gas: Va>reverse flow velocity of Ar gas: Vb" can be obtained, preventing Ar molecules from flowing from the space 2 back to the space 1.

It should be noted that "reducing the width of the flow path (pipe)" is synonymous with "disposing the throttle portion in the purge gas flow path" described in Embodiment 2 and Embodiment 3.

(Example) When the outer diameter is 200 mm and the width is 1 mm (i.e., the inner diameter is 198 mm), the cross-sectional area of the flow path is $\pi/4\times(0.2^2-0.198^2)=0.00063\ m^2$, and the flow velocity Va of the $N_2$ gas flowing through the flow path is 3.8E−04/0.00063=0.60 (m/s).

In other words, in this case, since Va=0.60 (m/s) whereas Vb=0.35 (m/s), Va>Vb (flow velocity of $N_2$ gas>reverse flow velocity of Ar gas) is established. Thus, it can be understood that the Ar gas does not flow from the space 2 back to the space 1.

Incidentally, when the outer diameter is, again, 200 mm and the width of the flow path is 5 mm (i.e., the inner diameter is 190 mm) which is 4 mm longer than the abovementioned 1 mm, the cross-sectional area of the flow path is $\pi/4\times(0.2^2-0.190^2)=0.00306\ m^2$, and the flow velocity of the $N_2$ gas (Va) flowing through the flow path is 3.8E−04/0.00306=0.12 (m/s).

In other words, in the case where the width of the flow path is as long as 5 mm as in the prior art, since Va=0.12 (m/s) whereas Vb=0.35 (m/s), Va<Vb (flow velocity of $N_2$ gas<reverse flow velocity of Ar gas) is established. Thus, it can be understood that the Ar gas flows from the space 2 back to the space 1.

As described above, the exhaust system (1000, 1010, 1020) of the vacuum pump according to each embodiment of the present invention can prevent changes in the gas composition and the amount of heat transmitted which are caused when components other than the gas components supplied as the purge gas flows backward around the temperature sensor unit 19.

Further, the function of the thread groove-type seal 80 can increase the pressure around the temperature sensor unit 19, promoting heat transfer.

In addition, measurement errors that are caused when the exhaust gas exhausted by the vacuum pump enters the periphery of the temperature sensor and corrodes the temperature sensor or when reaction products deposit.

Furthermore, since the flow rate of the purge gas is controlled only at the time of the temperature measurement, the consumption of the purge gas can be saved.

Consequently, the accuracy of measurement of the temperature of the rotating cylindrical body 10 by the temperature sensor unit 19 can be improved. As a result, the temperature of the rotating cylindrical body 10 can be measured accurately, preventing the occurrence of problems caused by overheating of the vacuum pump. Specifically, the rotating cylindrical body 10 can be prevented from being damaged by thermally expanding due to its increased temperature and then coming into contact with other parts. Also, the rotating portion and the stator portion can be prevented from being damaged by coming into contact with each other due to creep caused by prolonged high temperature. In addition, damage to the rotating cylindrical body 10 due to deterioration of the material strength thereof caused by overheating can also be prevented.

Note that the embodiments of the present invention and each modification thereof may be combined as necessary. An infrared temperature sensor may be used as the temperature sensor.

Further, the present invention can be modified in various ways without departing from the spirit of the present invention, and it goes without saying that the present invention extends to such modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump that receives supply of a purge gas from a flow rate adjuster connected thereto and has a temperature sensor unit disposed in a purge gas flow path for the supplied purge gas, the temperature sensor unit measuring a temperature of a rotating portion, the vacuum pump comprising, a stator column that accommodates an electrical unit for rotating the rotating portion;

a base for fixing the stator column; and a thread groove-type seal for causing at least some of the purge gas to flow back toward the temperature sensor unit is provided on a downstream side of the purge gas flow path in which the temperature sensor unit is disposed, wherein the stator column or the base includes a throttle portion provided in at least a part of the purge gas flow path at a downstream side from the temperature sensor unit, and configured to control the purge gas flow path in one direction, and the throttle portion is narrower than a part of the purge gas flow path in which the temperature sensor unit is provided.

2. The vacuum pump according to claim 1, wherein the throttle portion provided in the stator column has an outer diameter larger than the base.

3. The vacuum pump according to claim 1, wherein the throttle portion provided in the base has an outer diameter larger than the stator column.

4. A stator column of the vacuum pump according to claim 1, wherein the stator column comprises either one or both of the thread groove-type seal and the throttle portion.

5. A base of the vacuum pump according to claim 1, wherein the base comprises either one or both of the thread groove-type seal and the throttle portion.

6. An exhaust system of a vacuum pump, comprising:

a vacuum pump that has a temperature sensor unit disposed in a purge gas flow path to measure a temperature of a rotating portion, and has a stator column that accommodates an electrical unit for rotating the rotating portion; a base for fixing the stator column; and a thread groove-type seal for causing at least some of purge gas to flow back toward the temperature sensor unit, the thread groove-type seal being provided on a downstream side of the purge gas flow path in which the temperature sensor unit is disposed;

a purge gas storage device for storing the purge gas used in the vacuum pump; and flow rate adjuster for supplying the purge gas stored in the purge gas storage device to the vacuum pump, wherein the stator column or the base of the vacuum pump includes a throttle portion provided in at least a part of the purge gas flow path at a downstream side from the temperature sensor unit, and configured to control the purge gas flow path in one direction, the throttle portion is narrower than a part of the purge gas flow path in which the temperature sensor unit is provided, the exhaust system supplies the vacuum pump with the purge gas that satisfies either one of the following conditions at least when the temperature sensor unit measures the temperature of the rotating portion:

a flow velocity of the purge gas is higher than a flow velocity of an exhaust gas flowing backward in at least a part downstream of the temperature sensor unit, the exhaust gas being exhausted in the vacuum pump; and pressure of the purge gas around the temperature sensor unit creates an intermediate flow or a viscous flow.

* * * * *